US007140067B2

(12) United States Patent
Albert et al.

(10) Patent No.: US 7,140,067 B2
(45) Date of Patent: Nov. 28, 2006

(54) VACUUM CLEANER HANDLE AND STIFFENING ELEMENT

(75) Inventors: Wilma Albert, Wülfershausen (DE); Herbert Kess, Bad Neustadt (DE); Sebastian Räder, Bastheim (DE); Andreas Schlereth, Bad Neustadt (DE); Jörg Schröter, Gröbenzell (DE); Thomas Seith, Bad Neustadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/931,403

(22) Filed: Sep. 1, 2004

(65) Prior Publication Data

US 2005/0115016 A1 Jun. 2, 2005

Related U.S. Application Data

(63) Continuation of application No. PCT/EP03/02250, filed on Mar. 5, 2003.

(30) Foreign Application Priority Data

Mar. 5, 2002 (DE) ..... 202 03 498 U

(51) Int. Cl.
*A47L 9/32* (2006.01)

(52) U.S. Cl. ..... 15/327.2; 15/410; 15/412

(58) Field of Classification Search ..... 15/412, 15/325, 327.2, 410; 220/4.21, 4.24, 378, 220/683–685, 753, 755–756, 758; 16/421, 16/430

See application file for complete search history.

(56) References Cited

U.S. PATENT DOCUMENTS

| | | | | | |
|---|---|---|---|---|---|
| 857,680 | A | * | 6/1907 | Schulz | 220/4.21 |
| 872,379 | A | * | 12/1907 | Schulz | 220/4.21 |
| 1,129,635 | A | * | 2/1915 | Burke et al. | 220/4.24 |
| 1,268,064 | A | * | 5/1918 | Johnson | 220/4.24 |
| 1,784,516 | A | * | 12/1930 | Fairbanks | 220/4.21 |
| 3,550,804 | A | * | 12/1970 | De Remer | 220/4.24 |
| 3,619,850 | A | * | 11/1971 | Rideout et al. | 15/327.2 |
| 4,308,762 | A | * | 1/1982 | Jannard | 16/421 |
| 4,527,302 | A | | 7/1985 | Maurer et al. | 15/325 |
| 4,993,105 | A | * | 2/1991 | Buchtel et al. | 15/325 |
| 5,488,755 | A | * | 2/1996 | Chang | 16/430 |
| 2002/0104194 | A1 | * | 8/2002 | Erenaga | 16/430 |

FOREIGN PATENT DOCUMENTS

EP 1 127 529 A1 8/2001

* cited by examiner

*Primary Examiner*—Theresa T. Snider
(74) *Attorney, Agent, or Firm*—Craig J. Loest; Russell W. Warnock

(57) ABSTRACT

A household appliance, particularly a vacuum cleaner, has a housing of rigid material and formed with at least two interconnected housing parts and a handle that is also made of a rigid material. The household appliance is rendered especially rigid and the risk of losing grip of the handle of the appliance is reduced by integrating the handle into a stiffening element that is disposed at the intersection of the housing parts and by providing the handle with a cover that is made of a softer material.

20 Claims, 6 Drawing Sheets

Section D-D

VACUUM CLEANER HANDLE AND STIFFENING ELEMENT

CROSS-REFERENCE TO RELATED APPLICATIONS

This is a continuing application, under 35 U.S.C. § 120, of copending international application No. PCT/EP03/02250, filed Mar. 5, 2003, which designated the United States; this application also claims the priority, under 35 U.S.C. § 119, of German patent application No. 202 03 498.4, filed Mar. 5, 2002; the prior applications are herewith incorporated by reference in their entirety.

BACKGROUND OF THE INVENTION

Field of the Invention

The invention pertains to a household appliance, in particular to a vacuum cleaner, which has a casing formed of a rigid material. The casing has at least two casing parts that can be connected to each other and a handle that is likewise formed of rigid material.

Smaller, transportable household appliances, such as vacuum cleaners for example, have a casing on which a handle is provided, allowing the appliance to be picked up and carried from one place to another. The handle provided on the appliance consists of a similarly rigid or hard material as the casing of the appliance. This material is relatively smooth, so that it is easily possible for the handle to slip from a person's grasp when the appliance is picked up or carried. Furthermore, the casings of the appliances mentioned, which are usually constructed in two or more parts, are less rigid and sensitive to impact at the point where their casing separates.

SUMMARY OF THE INVENTION

It is accordingly an object of the invention to provide a household appliance, which overcomes the above-mentioned disadvantages of the heretofore-known devices and methods of this general type and which solves the shortcomings of the prior art are avoided by simple structural measures.

With the foregoing and other objects in view there is provided, in accordance with the invention, a household appliance, in particular a vacuum cleaner, comprising:

a casing of substantially rigid material, the casing having at least two casing parts formed to be connected to one another along a joint;

a stiffening element disposed at the joint of the casing parts; and a handle formed of rigid material and forming a component part of the stiffening element, and a covering on the handle formed of a relatively softer material.

The stiffening element provided according to the invention connects the casing parts in a particularly rigid connection, a reliable connection of the casing and handle being achieved by the handle being a component part of the stiffening element. Sureness during carrying is achieved by a covering of softer material. Softer materials naturally have a greater adhesive effect, so that the risk of slipping is significantly reduced when the handle provided with a covering of softer material is grasped. At the same time, the joint between the casing parts is stiffened in a way that reduces its impact sensitivity.

The terms "hard" or "harder" and "soft" or "softer" as used herein with reference to material characteristics should be understood as relative terms with reference to the materials used in the context of the specific household appliance and with reference to the desired stiffness, hardness, and frictional characteristics.

For production engineering reasons, it may be advantageous to spray the covering onto the handle by the 2-component injection-molding process. This allows the covering to be produced already during the production of the composite component comprising the stiffening element and the handle in one production step, in a low-cost and time-saving manner.

Alternatively, there is also the possibility of forming the covering as a separate part and applying it to the stiffening element. This may be of advantage if, because of the spatial size of the appliance, spraying it on directly is too laborious or too expensive. The fitting of a covering formed as a separate part becomes particularly simple if the covering can be snap-fitted onto the handle. The snap-fitting may take place for example by engaging lugs which are integrally formed on the inner side of the covering and engage or snap into clearances on the casing. At a later stage of production, production differentiation is still possible.

An improvement in the adhesive effect of the covering can be achieved by grooves and/or pimples being formed at least in the central region of the stiffening element having the handle. The grooves and/or pimples form a coarse or rough structure, thereby preventing the handle from slipping out of the user's hand.

Household appliances, and in particular vacuum cleaners, have a casing comprising two casing parts which can be connected to each other. In the case of vacuum cleaners, depending on the structural design of the casing, it is necessary for the two casing parts to be connected to each other as tightly as possible. Therefore, in the case of vacuum cleaners, a corresponding seal is necessary at the separating joint between the two casing parts. According to a further refinement of the invention, at least one impact strip which can be inserted into the separating joint of the casing parts to be connected to each other is integrally formed as one part on the covering. This has the advantage that it is possible to dispense with a separate elastomeric seal. Such seals are generally required to seal the dust compartment from the outside in a dust-tight and low-noise manner. If a covering of soft material according to the invention is already provided, this soft material may at the same time form the elastic seal. The seal is provided with a given position and shape by the stiffening frame, whereby fitting of the seal is made easier.

In an advantageous way, the covering and the seal may be formed in such a way that they at the same time assume the function of an impact strip. The covering may run along the outer edge of the stiffening element at the joint between the casing halves and protrude laterally beyond the surface of the casing. Consequently, in particular in the case of mobile vacuum cleaners, which often have to be propelled during cleaning work to be carried out and can thereby hit objects, a corresponding impact protection is achieved. The mobile vacuum cleaner in this case only hits objects with the protruding impact strip, and the casing that is set back from the impact strip is protected.

In conjunction with the stiffening element, a robust construction is obtained for the casing. The stiffening element preferably has a frame part formed from hard material, which is provided at the joint between the casing parts which can be connected. The fact that the stiffening element is formed as a closed frame profile provides a particularly stable construction of the stiffening element. As a result, the stability of the vacuum cleaner casing can be significantly increased in a simple way.

The frame part may be formed as a separate component which can be connected to one of the casing parts. In particular in the case of large household appliances, or vacuum cleaners, it may be less costly to prefabricate the frame part, for example by the plastics injection-molding process, and subsequently fasten it to a casing part. On the other hand, the handle and the frame part may be made as one part. A particularly rigid construction is obtained if the frame part is formed as a one-part closed frame profile, which encloses a predetermined portion of the casing contour. The arrangement of the frame profile along the casing contour, in particular of a vacuum cleaner, has the effect that the frame part is attached to the appliance as far out as possible, and as a result is particularly resistant to torsion.

A separate sealing part for the sealing of the dust compartment by the dust compartment cover is made unnecessary by a peripheral seal being provided on the frame part, extending along a separating joint between the casing edge and the dust receiving compartment.

Other features which are considered as characteristic for the invention are set forth in the appended claims.

Although the invention is illustrated and described herein as embodied in a household appliance, in particular vacuum cleaner, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
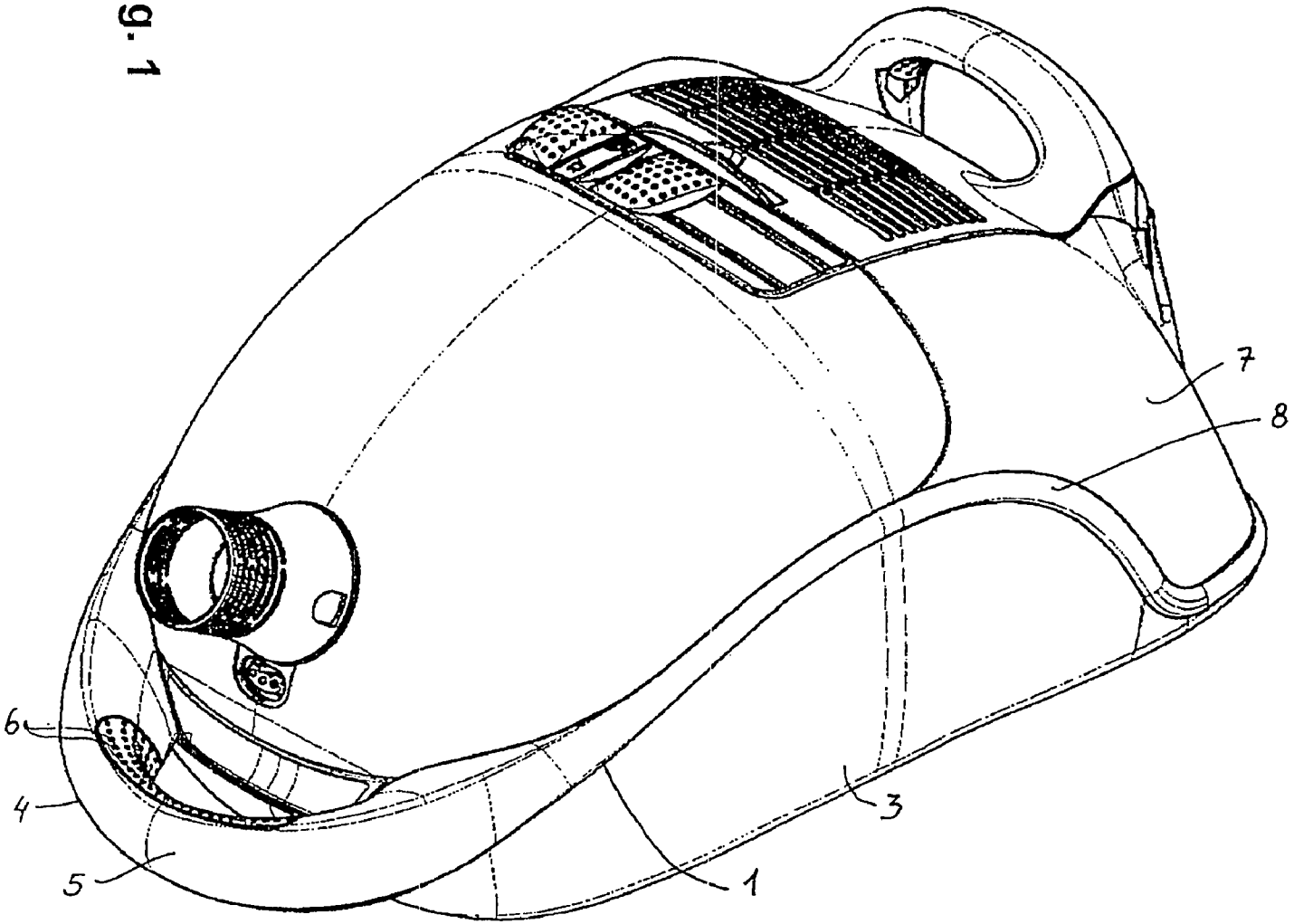
FIG. 1 is a perspective view of a vacuum cleaner according to the invention.

Referring now to the figures of the drawing in detail and first, particularly, to FIG. 1 thereof, the illustrated vacuum cleaner according to the invention has a stiffening element 1 framing the vacuum cleaner casing. The casing, or housing, has a lower part 3 and an upper part 7. The stiffening element 1 is disposed between the lower casing part 3 and the upper casing part 7. An arcuately shaped handle 4 is integrally formed on the stiffening element 1. The handle 4 is provided with a covering 5, which is formed of an elastomeric plastic. In the central region of the handle 4, the covering 5 is provided with pimples 6 to increase the adhesive effect, that is, the frictional effects. Other non-slip surface structures are also possible, for example channels or grooves, which serve to increase the adhesive effect. The covering may be formed in a 2-component injection molding process, i.e., with overmolding, or it may be separately formed and snapped onto the stiffening element. An impact strip 8 is integrally formed on the stiffening element 1. The impact strip 8 (i.e., a bump guard) is formed as an elastic bead which protrudes outward from the plane of the casing parts 3 and 7. The impact strip 8 adjoins at one end of the handle 4 and runs along the lateral periphery of the vacuum cleaner right around it until it merges again into the handle 4 at a second end of the latter. The peripheral impact strip 8 protects the vacuum cleaner against knocks around its entire lateral periphery.

Figure 2:
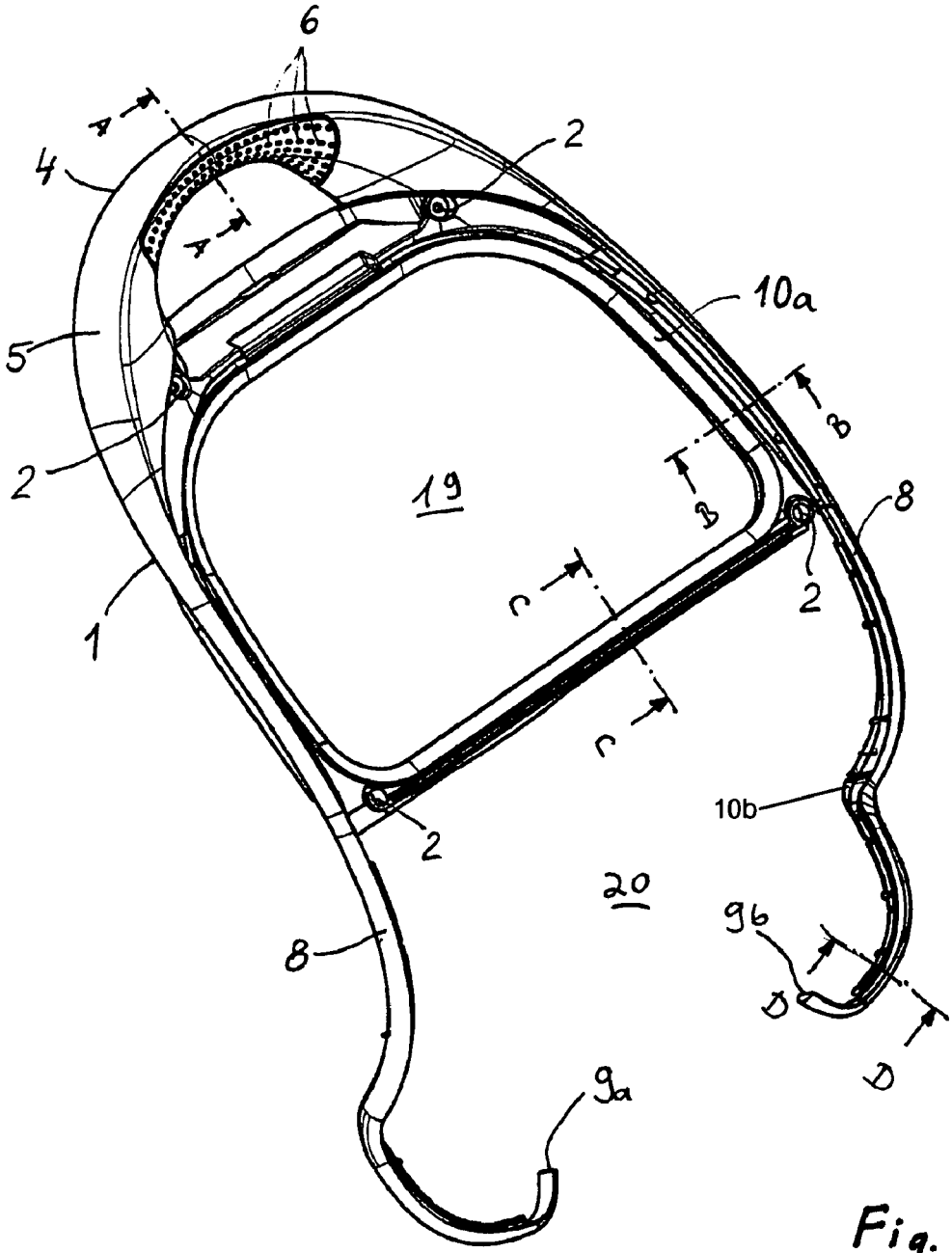
FIG. 2 is a perspective view of a frame-shaped stiffening element with a handle, of the vacuum cleaner shown in FIG. 1.

FIG. 2 shows the stiffening element 1 of the vacuum cleaner from FIG. 1. The stiffening element 1 comprises a central frame-shaped frame part 11 of hard material. The frame part 11 has at each of its four corner regions a screw hole 2, through which the frame part 11 is fastened to the lower casing part 3 by means of screws (not represented). Along the inner edge of the frame part 11, an elastomeric seal 10 is integrally formed on the frame part 11. The seal 10 includes a seal 10*a* adjacent the dust compartment and a seal 10*b* adjacent the motor compartment. In the fitted state, the seal 10*a* bears against a casing cover of the dust compartment of the vacuum cleaner in a pressure-tight manner. Along the outer edge of the frame part 11, the elastomeric impact strip 8 is integrally formed on the frame part 11. The impact strip 8 extends not only along the outer edge of the frame part 11, but is extended beyond the frame part 11 in such a way that, in the fitted state of the stiffening element 1, the impact strip 8 runs over the entire lateral periphery of the vacuum cleaner. The impact strip 8 is therefore not only integrally formed on the left-hand and right-hand lateral outer edges of the frame part 11, but also comprises two free ends 9*a* and 9*b*. In the fitted state, the free ends 9*a* and 9*b* run along the separating joint between the casing halves which enclose the motor compartment 20. The free ends 9*a* and 9*b* not only serve as an impact strip 8, but at the same time also form the seal 10*b*, which seals the motor compartment. On the side of the frame part 11 lying opposite the free ends 9*a* and 9*b*, the impact strip 8 merges smoothly into the handle 4. Formed on the outer side of the handle 4 by the merging impact strip 8 is an elastomeric covering 5, which on the one hand also serves as an impact strip and at the same time also serves as a soft, nonslip gripping region. Integrally formed on the inner side of the handle 4 is the additional elastomeric portion, which is provided with pimples 6. The pimples 6 increase the adhesive properties, whereby slipping of the vacuum cleaner from the user's hand is prevented.

Figure 3:
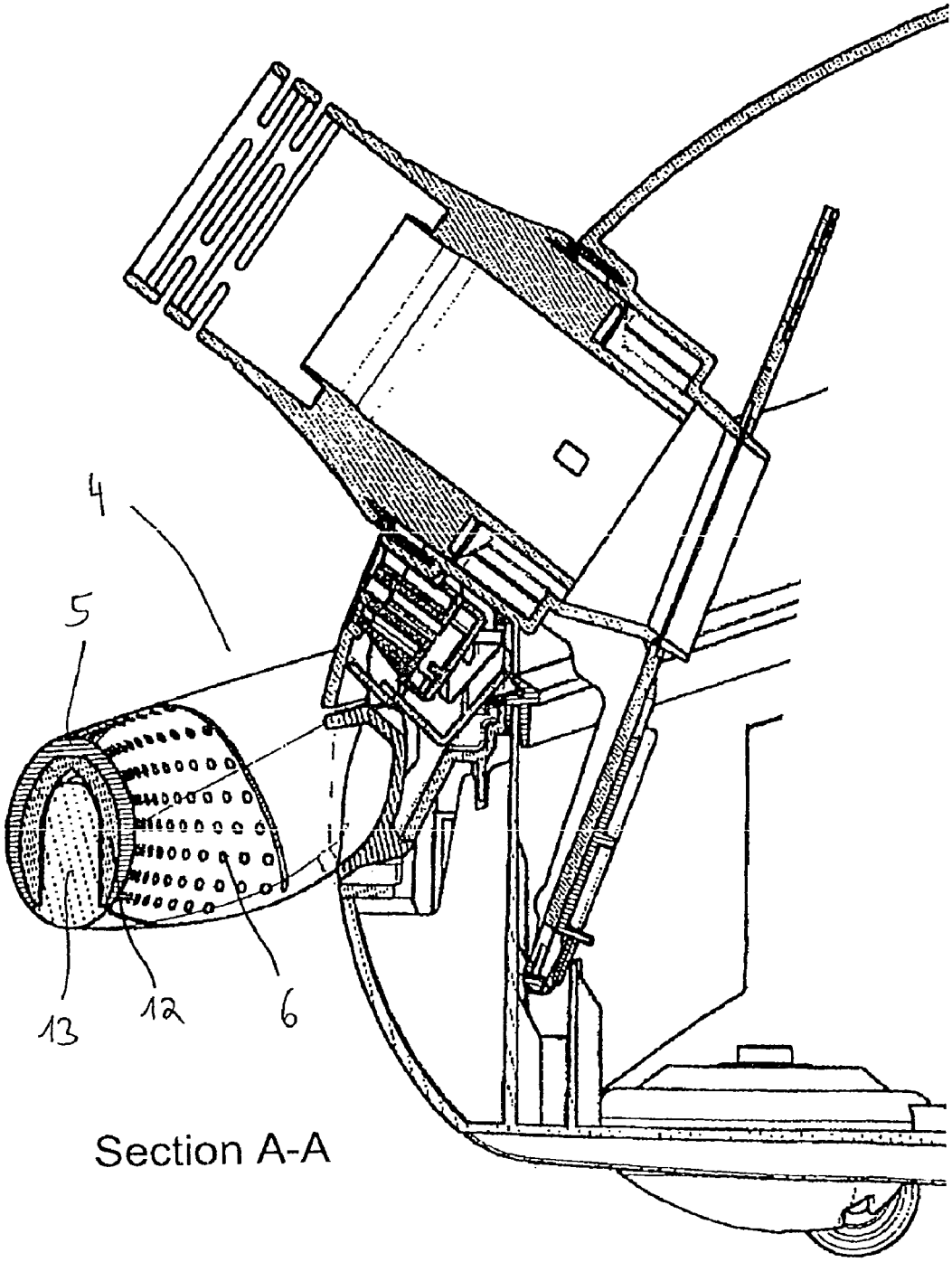
FIG. 3 is a sectional view taken through the handle region of the stiffening element along the line A—A in FIG. 2.

In FIG. 3, the handle 4 is shown in a sectional view A—A. The stiffening element 1 of hard material is extended in an arcuate manner beyond the frame part 11, producing a D-shaped frame portion 12, which is adjacent to the frame part 11. This frame portion 12 forms a basic structure of the handle 4. Integrally formed in the frame portion 12 of hard material, at its downwardly open cavity, is an elastomeric filling 13. On the side of the frame portion 12 lying opposite the elastomer filling 13, the covering 5 is applied. The covering 5 is of elastomeric material and has pimples 6, allowing the handle to be grasped in a nonslip manner.

Figure 4:
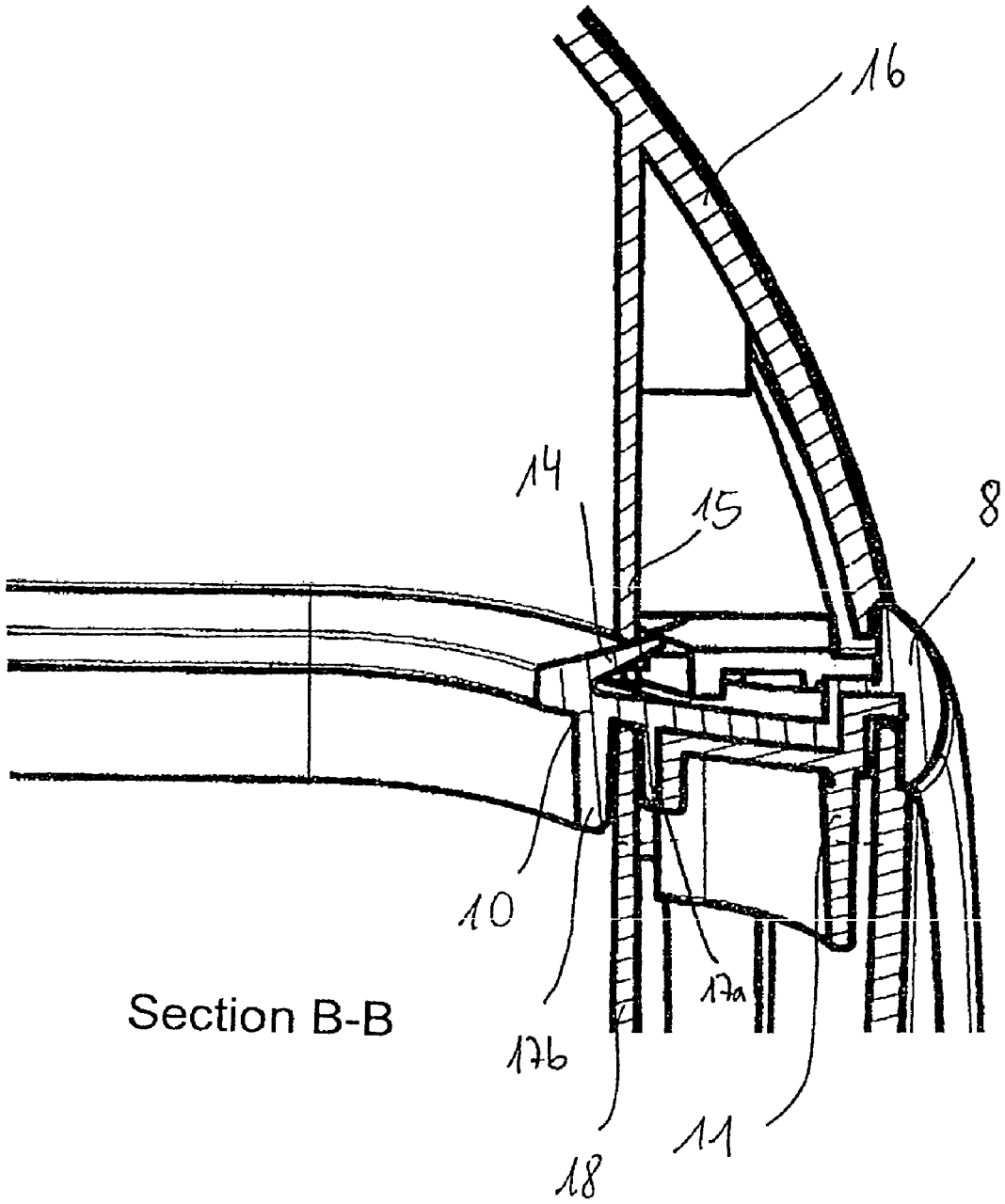
FIG. 4 is a sectional view taken through a lateral leg of the frame of the stiffening element along the line B—B in FIG. 2.

In FIG. 4, the frame part 11 is shown in a sectional view B—B in the fitted state. Integrally formed on the upper side of the frame part 11 is a material comprising elastomeric material. On the outer side, the impact strip 8 is formed by this elastomeric material. This impact strip 8 has an approximately D-shaped cross section. The D shape produces a progressive impact behavior, i.e. with increasing depth of penetration in the case of impact against the D-shaped impact strip 8, the elasticity decreases and the impact strip offers increased resistance to the impact also in the case of harder knocks. The seal 10 is integrally formed on the inner side of the frame part 11. The seal 10 consists of the same material as the impact strip 8 and is integrally formed with the latter in one piece on the frame part 11. The seal 10 has an upwardly protruding sealing lip 14, which runs around the entire periphery of the frame part 11. In the fitted state, the sealing lip 14 bears against a casing edge 15 of a dust compartment cover 16. The seal 10 has at its lower end two legs 17*a* and 17*b* running parallel along the frame part 11. These legs 17*a* and 17*b* form a guiding groove into which a casing wall 18 of the lower casing part 3 is inserted in the fitted state. As a result, the casing wall 18 forms a stable receptacle and abutment for guiding the sealing lip 14.

Figure 5:
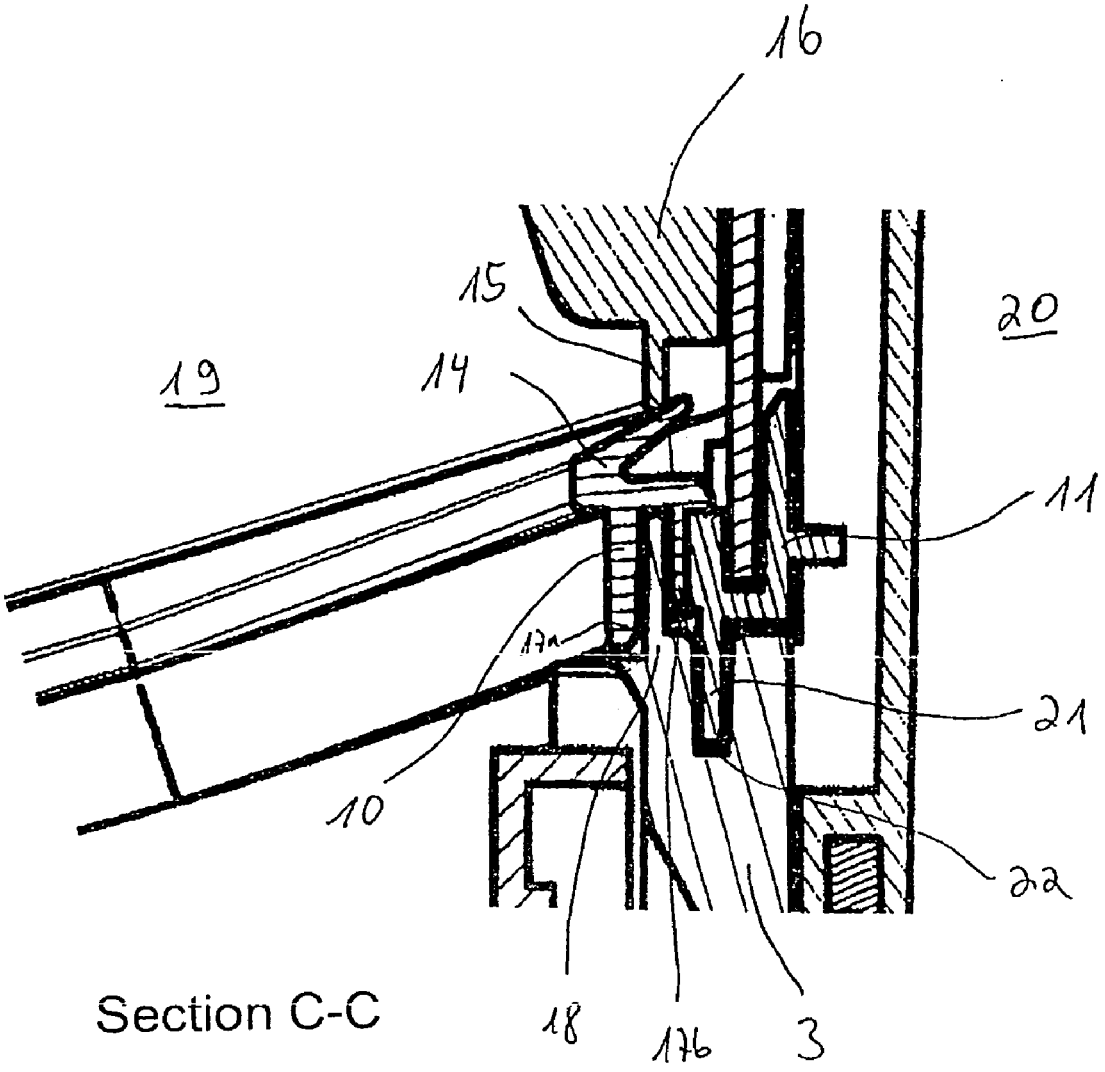
FIG. 5 is a sectional view taken through a leg of the frame of the stiffening element along the line C—C in FIG. 2, lying opposite the handle part.

In FIG. 5, the frame part 11 is shown in a sectional view C—C in the fitted state. The seal 10 is integrally formed on the inner side of the frame part 11. The seal 10 is formed of the same material as the impact strip 8 and is integrally formed with the latter in one piece on the frame part 11. The seal 10 has an upwardly protruding sealing lip 14, which runs around the entire periphery of the frame part 11. In the fitted state, the sealing lip 14 bears against a casing edge 15 of a dust compartment cover 16. The seal 10 has at its lower end two legs 17*a* and 17*b* running parallel along the frame part 11. These legs 17*a* and 17*b* form a guiding groove into which a casing wall 18 of the lower casing part 3 is inserted in the fitted state. As a result, the casing wall 18 also forms a stable receptacle and abutment for guiding the sealing lip 14 in the region between the dust compartment 19 and the motor compartment 20. In the region of the frame part 11 which lies between the dust compartment 19 and the motor compartment 20, there is no need for an impact strip 8 to be integrally formed. In order to fix the stiffening element 1 stably to the lower casing half 3 in particular in this region, integrally formed on the cross section of the frame part 11 is a hard spring leg 21, which engages in an assigned groove 22 in the lower casing half 3. As a result, the frame part 11 is additionally fixed in its position in the region between the dust compartment 19 and the motor compartment 20.

Figure 6:
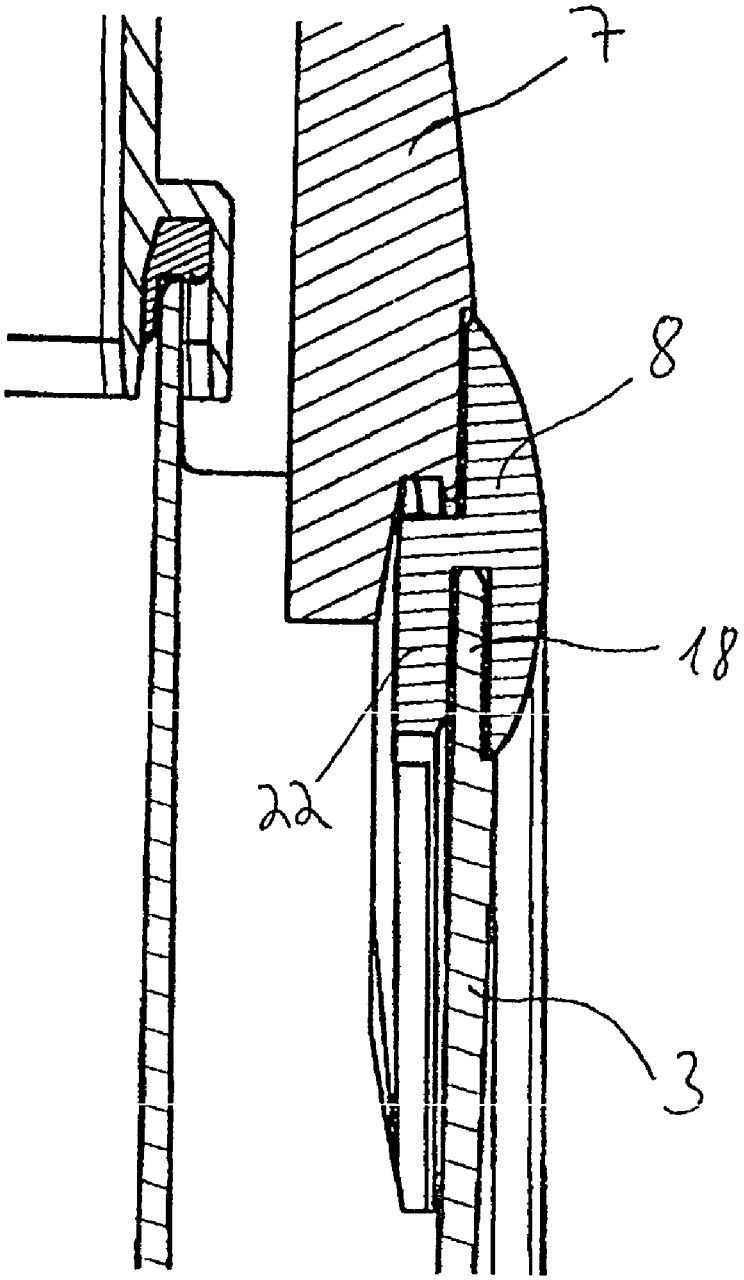
FIG. 6 is a sectional view taken through one of the free elastic ends of the stiffening element along the line D—D in FIG. 2.

In FIG. 6, the frame part 11 is shown in a sectional view D—D in the fitted state. In this portion, which is located in the neighborhood of the free ends 9*a*, 9*b*, the elastomeric material is formed as the impact strip 8. The upper casing half 7 and the lower casing half 3 are undetachably connected to each other in this region, i.e. these two casing halves cannot be separated during use. Therefore, there is no need for the formation of an inner sealing lip in this region. In this portion, however, the impact strip 8 has a leg portion 22, which together with the impact strip 8 encloses a groove 23. The casing wall 18 of the lower casing half 3 engages in the groove 23. This concealed connection provides the elastomeric free ends 9*a*, 9*b* with positional stabilization during fitting and makes the impact strip 8 be clamped between the upper casing half 7 and the lower casing half 3 in this portion.

We claim:

1. A vacuum cleaner, comprising:

a casing of substantially rigid material, said casing having at least two casing parts formed to be connected to one another along a joint;

a suction source disposed within the casing and providing an air flow for the vacuum cleaner and an inlet on the casing for receiving the air flow;

a stiffening element disposed at said joint of said casing parts; and a handle formed of rigid material and being formed from said stiffening element and being non-integral and distinct from the casing parts, and a covering on said handle formed of a relatively softer material.

2. The vacuum cleaner according to claim 1, wherein said covering is directly molded onto the handle.

3. The vacuum cleaner according to claim 1, wherein said covering is a separate part from said stiffening element and attached to said stiffening element.

4. The vacuum cleaner according to claim 3, wherein said covering is configured to be snap-fitted onto said stiffening element.

5. The vacuum cleaner according to claim 1, wherein said covering, at least at a central region of said stiffening element having said handle, is formed with at least one of grooves and pimples.

6. The vacuum cleaner according to claim 1, which comprises a seal integrally formed as one part on said covering and inserted into said joint between said casing parts.

7. The vacuum cleaner according to claim 6, wherein said covering and said seal are configured to also function as an impact strip.

8. The vacuum cleaner according to claim 1, wherein said stiffening element has a frame part formed of hard material and disposed at said joint between said casing parts.

9. The vacuum cleaner according to claim 8, wherein said frame part is formed as a separate component to be connected to one of said casing parts.

10. The vacuum cleaner according to claim 8, wherein said frame part and said handle are formed as one part.

11. The vacuum cleaner according to claim 8, wherein said frame part is formed as a one-part closed frame profile enclosing a predetermined portion of a casing contour of said casing.

12. The vacuum cleaner according to claim 11, wherein said predetermined portion is the casing contour of a vacuum cleaner.

13. The vacuum cleaner according to claim 12, which comprises a peripheral seal extending along a separating joint between a casing edge and a dust receiving compartment is provided on the frame part.

14. A vacuum cleaner comprising:

a casing of substantially rigid material, said casing having at least two casing parts connected to one another;

a suction source disposed within the casing and providing an air flow for the vacuum cleaner and an inlet on the casing for receiving the air flow;

a stiffening element disposed between said casing parts and having a handle projecting beyond the casing parts, the handle including:

a rigid frame part formed from a first material;

a covering portion on the frame part formed from a second material being softer than the first material.

15. The vacuum cleaner according to claim 14, wherein the covering portion is directly molded onto the frame part.

16. The vacuum cleaner according to claim 14, wherein the covering portion includes an inner portion facing inwardly toward the casing and an outer portion facing outwardly away from casing, the inner portion having an uneven surface including to provide and increased adhesive effect, the outer portion being substantially smooth.

17. The vacuum cleaner according to claim 14, further comprising a seal integrally formed with the stiffening element and formed from a seal material being softer than the first material.

18. A vacuum cleaner comprising:

a casing of substantially rigid material, the casing having at least two casing parts coupled to one another along a joint;

a suction source disposed within the casing and providing an air flow for the vacuum cleaner and an inlet on the casing for receiving the air flow;

a stiffening element disposed at the joint of said casing parts, the stiffening element including:

a handle formed from a first material and projecting outwardly from the casing; and a seal integrally formed with the stiffening element and disposed between the casing parts, the seal being formed from a seal material being softer than the first material.

19. The vacuum cleaner according to claim 18, wherein the stiffening element includes an impact strip extending substantially around the periphery of the casing and being made from the first material.

20. The vacuum cleaner according to claim 18, wherein the casing includes a dust compartment and a motor compartment disposed within the casing, the seal extending between the dust compartment and the motor compartment.

* * * * *